US011596224B2

(12) United States Patent
Fu

(10) Patent No.: US 11,596,224 B2
(45) Date of Patent: Mar. 7, 2023

(54) SUPINELY READING STAND

(71) Applicant: Guoping Fu, Shenzhen (CN)

(72) Inventor: Guoping Fu, Shenzhen (CN)

( * ) Notice: Subject to any disclaimer, the term of this patent is extended or adjusted under 35 U.S.C. 154(b) by 0 days.

(21) Appl. No.: 16/992,095

(22) Filed: Aug. 12, 2020

(65) Prior Publication Data

US 2020/0367643 A1 Nov. 26, 2020

Related U.S. Application Data

(63) Continuation-in-part of application No. PCT/CN2019/073289, filed on Jan. 27, 2019.

(30) Foreign Application Priority Data

Feb. 13, 2018 (CN) ..... 201810147650.7

(51) Int. Cl.
*A47B 23/00* (2006.01)
*A47B 3/00* (2006.01)
*A47B 9/20* (2006.01)

(52) U.S. Cl.
CPC ..... *A47B 23/007* (2013.01); *A47B 3/00* (2013.01); *A47B 9/20* (2013.01); *A47B 2023/008* (2013.01)

(58) Field of Classification Search
None
See application file for complete search history.

(56) References Cited

U.S. PATENT DOCUMENTS 2,810,231 A * 10/1957 Lykes ..... A47B 23/06 248/456
4,496,126 A * 1/1985 Melton ..... A47B 23/06 248/447.2
4,718,630 A * 1/1988 Richard ..... A47B 23/007 108/1
4,867,407 A * 9/1989 Becker ..... A47B 23/007 248/447.2
7,566,041 B2 * 7/2009 Ibara ..... A47B 23/06 248/444
9,936,803 B2 * 4/2018 Shivers ..... F16M 11/28
2015/0173506 A1 6/2015 Carter
2016/0058176 A1 * 3/2016 Shivers ..... A47B 23/007 248/445
2017/0112277 A1 * 4/2017 Shivers ..... F16M 11/28

FOREIGN PATENT DOCUMENTS

CN 202552770 U 11/2012
DE 427980 4/1926
ES 1073468 U 12/2010
JP 2001-224442 A 8/2001
JP 2016-16302 A 2/2016

OTHER PUBLICATIONS

WIPO, International Search Report and Written Opinion, PCT/CN2019/073289, dated Apr. 26, 2019, 6 pages.

* cited by examiner

*Primary Examiner* — Steven M Marsh

(57) ABSTRACT

A supinely reading stand which barely blocks the text of the book, barely interferes with the sight of the eyes, and is more simply constructed, easy in assembly and lower-cost. The supinely reading stand comprises a book-supporting structure. The book-supporting structure comprises a four-sided frame and at least one tension-resistant thin line distributed in the inner area of the four-sided frame. The four-sided frame includes first opposite sides and second opposite sides. The tension-resistant thin line(s) is/are connected to the first opposite sides of the four-sided frame in tension state.

2 Claims, 12 Drawing Sheets

SUPINELY READING STAND

CROSS-REFERENCE TO RELATED APPLICATIONS

This application is a continuation of PCT Application NO. PCT/CN2019/073289 filed on Jan. 27, 2019, which claims priority to Chinese Patent Application NO. 201810147650.7 filed on Feb. 13, 2018, both of which are hereby incorporated by reference in their entireties.

BACKGROUND OF THE INVENTION

The invention relates to the field of reading stands, and more particularly to a reading stand for a user in a supine position.

Nowadays, cervical spondylosis and lumbar spondylosis are becoming more and more prevalent. Such patients cannot bend their heads or spines for a long time, but often need lie down for a while. There existed many reading stands in the Prior Art that allowed reading in a supine position. Chinese Utility Patent CN2619518Y discloses a reading stand that enables one to read on a bed, including a tempered glass board. While in use, the opened book is supported by the glass board with the text sides facing down towards eyes of an individual lying supine, so the one is looking the book through the glass board. Chinese utility patent CN202552770U discloses a technical solution in which a book is supported by multiple iron wires, for an individual lying supine under the book to look up to read the book.

Although the above two solutions allow people to read books lying on their backs, they will both block or hide the text of the book to a certain extent. Although the glass board is transparent, the light transmittance is limited after all; and the text of the book is facing downward, the light is very poor so the text looks darker; and the glass board may reflect light to interfere with vision and to lower the transmittance more. The solution of supporting the book with iron wires will also cause the iron wires to block part of the text, which will interfere with the sight of the eyes and cause a poor reading experience. The technical solutions in the aforementioned patents still have the problems of complex products structure and troublesome page-turning ways. Because the text sides of the book is blocked by supportive parts, it is necessary to remove the book from the support when turning the page, and then put the book back after it is turned by hands, which is very inconvenient to operate.

SUMMARY OF THE INVENTION

The present invention provides a supinely reading stand which barely blocks the text of the book, barely interferes with the sight of the eyes, and is more simply constructed, easier in assembly and lower-cost. The present invention comprises a book-supporting structure and a positioning structure. The book-supporting structure comprises a four-sided frame and at least one tension-resistant thin line distributed in the inner area of the four-sided frame. The four-sided frame includes first opposite sides and second opposite sides. The tension-resistant thin line(s) is/are tensely stretched and connected to the first opposite sides of the four-sided frame.

Term Explanation:

A four-sided frame includes four sides (two pairs). For the convenience of name, one pair of opposite sides is called the first opposite sides, and the other pair of opposite sides is called the second opposite sides. Each pair of opposite sides includes two sides in opposite positions. The four-sided frame in the present invention is substantially a rectangle, which means no need to be a strict rectangle. As long as it can be connected with the tensioned thin line(s) and, as a whole, is able to support the opened book, it belongs to the four-sided frame of the present invention. The tension-resistant thin line mentioned in the present invention refers to a flexible, bendable and windable thin line that can be tensioned and withstand a certain tension with a small stretch deformation. For example, the commonly used guitar's steel string and fishing line are acceptable, while the rubber band used to tie the hair is not suggested. Although it can be tightened, it is actually elastic, so the stretch deformation is too large for the line to support the book to keep it in a certain position. The tension-resistant thin line may be directly wound round the corresponding side of the frame and tied tightly, or threaded through a wiring hole located at the corresponding side of the frame or wound round a terminal mounted at the corresponding side of the frame (such as small cylinders, ordinary nails or screws with holes in the nuts, etc.), and then be tied or fixed firmly.

In the situation that only one tension-resistant thin line is connected to the first opposite sides of the four-sided frame, this thin line and the second opposite sides of the four-sided frame form a total of three supporting members that can be used to support the book. Preferably, for ease of use, these three supporting members are parallel. When in use, open the book and put it on the three supporting members with the text facing down. The blank part of the header and footer are placed on the second opposite sides of the four-sided frame respectively, and the middle part of the book is supported by the thin line. By just adjusting the position of the book slightly, the thin line can just pass through a blank space between text lines in the book (Most of the modern books' words are printed in horizontal. Ignore the vertically arranged ones), such that the reading stand of the present invention is able to support the book steadily without blocking or hiding the text of the book, which brings unexpected benefits. For a small book, users may use just two of the three supporting members mentioned above. Due to the line is thin and the papers of the book are soft, it brings another effect that the line seems to be embedded into the papers a bit, which reduces the horizontal sliding relative to the thin line, thus reducing the probability that the book falls off.

Of course, we can also arrange more than one tension-resistant thin line in the four-sided frame, so that for books of any size, we can find a suitable number and spacing of supporting members to support it. When plural thin lines are used to support the book, even if there is a thin line that cannot be adjusted to stay in a space between text lines in the book, it covers only the extremely small part the text, which looks like the appearance that drawing a line across the text with a pen, and does not affect the recognition and reading of the words.

The advantages of the present invention also include: simple structure; easy for assembly; can be made from readily available materials; lower-cost and so on. These and other features and advantages of the present invention will be presented in more detail in the following specification of the invention and the accompanying figures.

DETAILED DESCRIPTION OF EMBODIMENTS OF THE INVENTION

Figure 1:
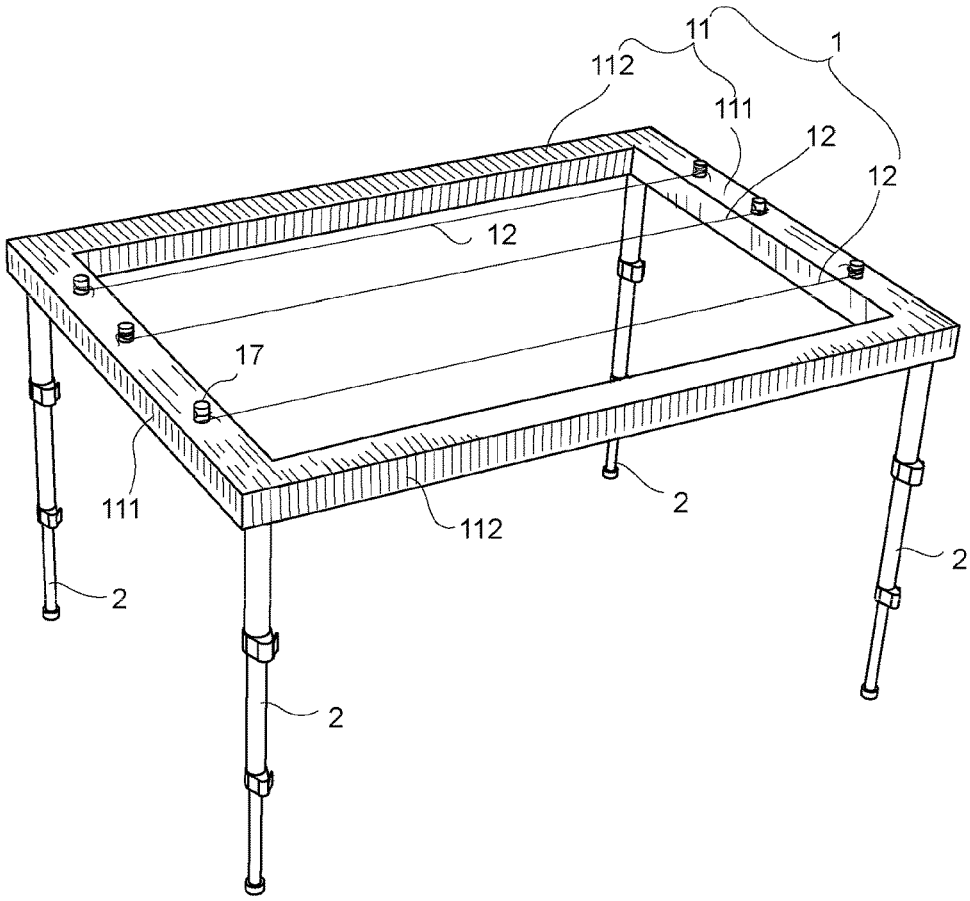
FIG. 1 is a perspective view of a basic embodiment of the present invention.
Figure 2:
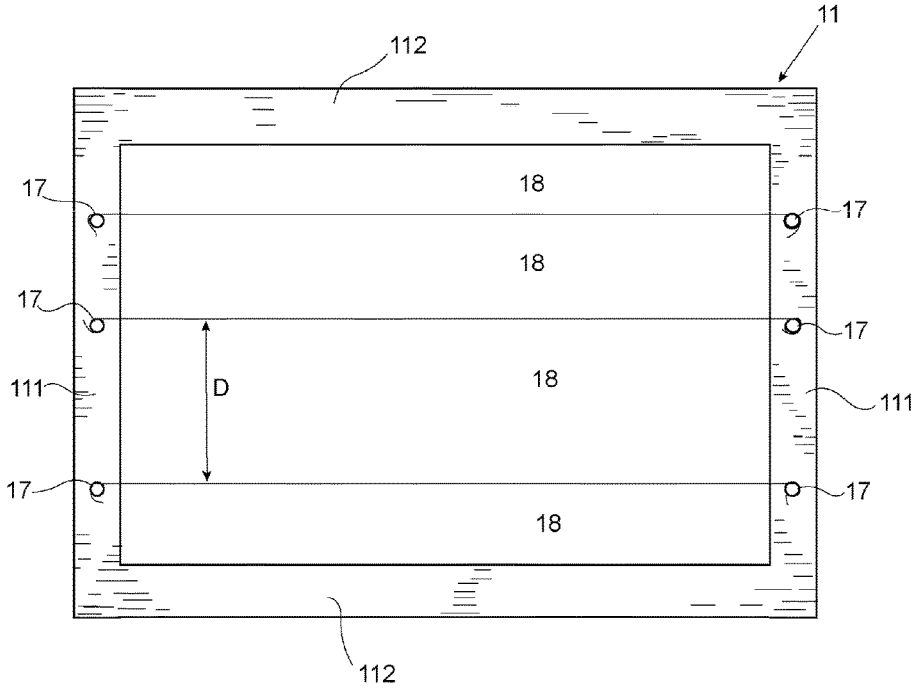
FIG. 2 is a top plan view of the embodiment shown in FIG. 1.

Please look at FIGS. 1 and 2. These two figures show a basic embodiment of the present invention. FIG. 1 is a perspective view and FIG. 2 is a top view. The figured supinely reading stand includes a book-supporting structure 1. The book-supporting structure 1 includes a four-sided frame 11 and three tension-resistant thin lines 12 distributed in the inner area of the four-sided frame 11; the four-sided frame 11 includes first opposite sides 111 and second opposite sides 112; the tension-resistant thin lines 12 are tensely stretched and connected to the first opposite sides 111 of the four-sided frame 11 via terminals 17. When installing the thin lines 12, firstly tie one end of each thin line 12 to a terminal 17; and then pull the thin line tightly to the corresponding terminal on the opposite side; and then wind it around the terminal to prevent it from loose and tie it tightly; at last cut off the excess length. After using for a long time, the thin lines may possibly become loose. The user may cut off the old thin lines and repeat the above steps to install new thin lines. Of course, the tension-resistant thin lines 12 can also be directly wound at the appropriate positions of the four-sided frame without via the terminals. The four-sided frame can be made of wood, metal or plastic material, with the size 40 cm wide and 60 cm long, thus being able to support almost all different sizes of the ordinary books. In the case of taking a metal wire for the tension-resistant thin line, as long as it can withstand a certain tension force, the thinner line should be selected as much as possible to reduce the obstruction of the text. After trials, a metal wire with a diameter of 0.1~0.6 mm can bring a good effect, while transparent polymer material with a diameter of 0.3~1 mm will bring excellent performance, such as nylon fishing lines. As it is transparent, it causes almost no obstruction of the text. By using transparent polymer lines, the supinely reading stand can also support a tablet, transparent polymer lines going in front of the screen with little interference to the light of the screen.

Figure 3:
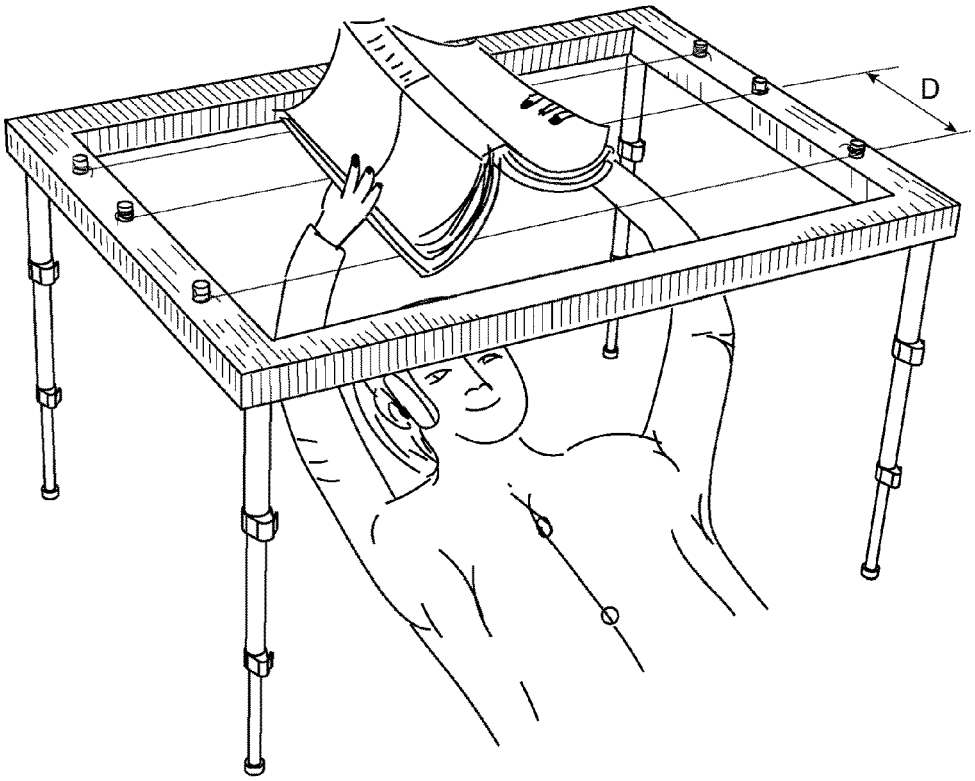
FIG. 3 is a schematic diagram of an embodiment of the present invention that allows users to turn the page.

The tension-resistant thin lines 12 in the above embodiment divide the four-sided frame 11 into a plurality of gaps (as shown by the NO. 18 in FIG. 2). The widths of these gaps may be equal or unequal. As a further improvement, at least one of the gaps is wider than 8 cm, where the typical position is measured is shown in FIG. 2, D, in order to let a user lying supine stretch hands and the front of the forearms through this gap to hold the book to move it and turn the page (FIG. 3). While turning the page, the user only needs to hold the two sides of the book with both hands; lift the book slightly upward; use the index fingers and thumbs of both hands to turn the page; and then put the book down. The whole process is almost as convenient as the way turning the page when reading a book on a desk.

Figure 4:
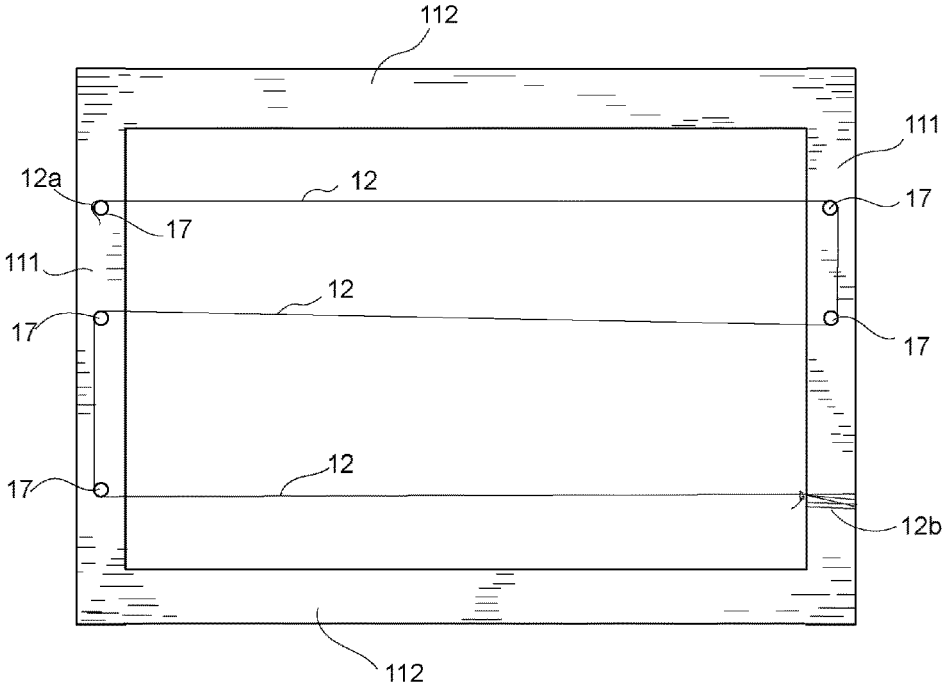
FIG. 4 is a top plan view showing another way of fixing the tension-resistant thin lines, according to an embodiment of the present invention.
Figure 5:
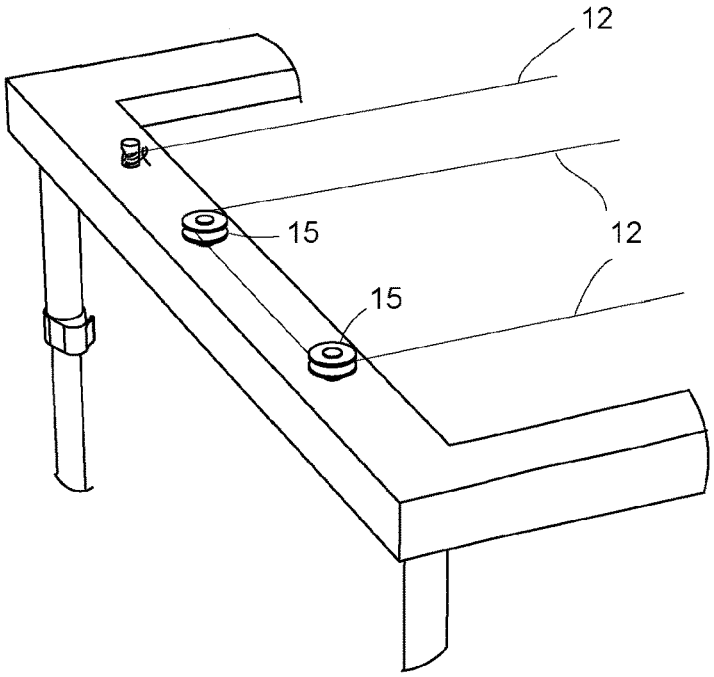
FIG. 5 is a partial enlarged schematic diagram of an embodiment using a pulley for winding.

The top view in FIG. 4 shows another way of fixing the tension-resistant thin lines. In this embodiment, the three tension-resistant thin lines 12 are actually one entire line (a single continuous line), which bypasses terminals 17 mounted on the first opposite sides 111 of the four-sided frame in a certain path, and is tensioned and then attached to the first opposite sides 111 at the two ends separately, thus forming the three tension-resistant thin lines in structural appearance. 12*a* and 12*b* indicate the two ends of the entire thin line. 12*a* is fixed on the first opposite sides 111 of the four-sided frame via a terminal, while 12*b* is directly wound around the first opposite sides 111 and tied tightly. In the aspect of function, each of the formed lines itself can support the book, which works the same as the lines set separately, but saves more time while installing the line. Further, the terminal is provided with a pulley 15 sleeved thereon (see FIG. 5). Said single continuous tension-resistant thin line 12 goes pressing round the pulley(s) 15, by which means the friction is reduced and the tension force will be more even in the line, thus being tensioned better.

Figure 6:
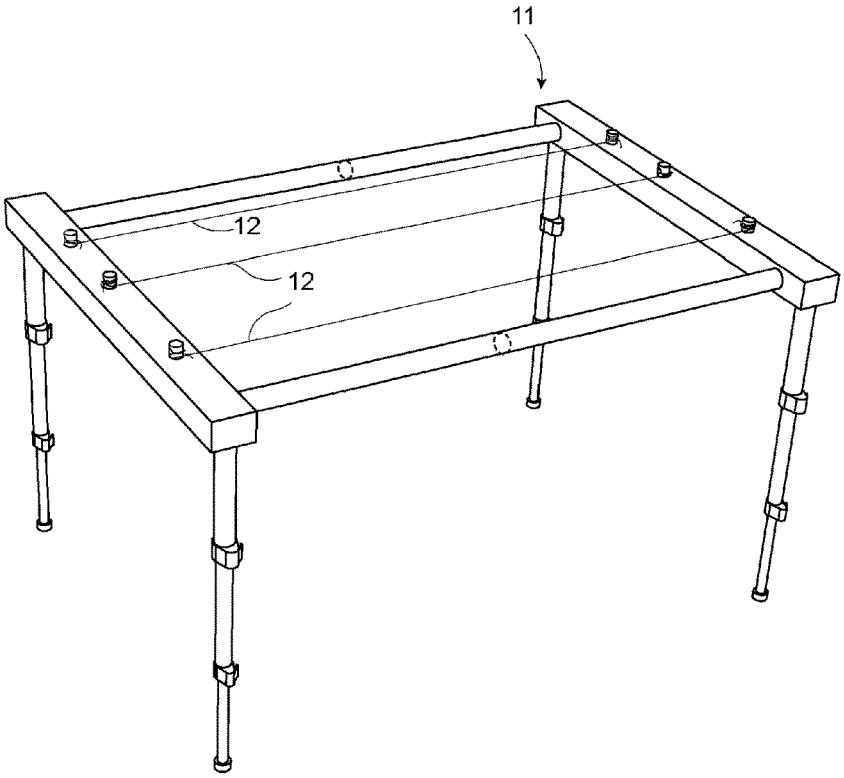
FIG. 6 is a perspective view of an embodiment with a disassemblable proposal of the four-sided frame.

As a further improvement, the four-sided frame of the present disclosure is disassemblable. That means, it may be disassembled for saving space when in transport or in an idle state. FIG. 6 shows a perspective view, and FIG. 7 is the top view (the thin lines are omitted and not drawn).

Figure 7:
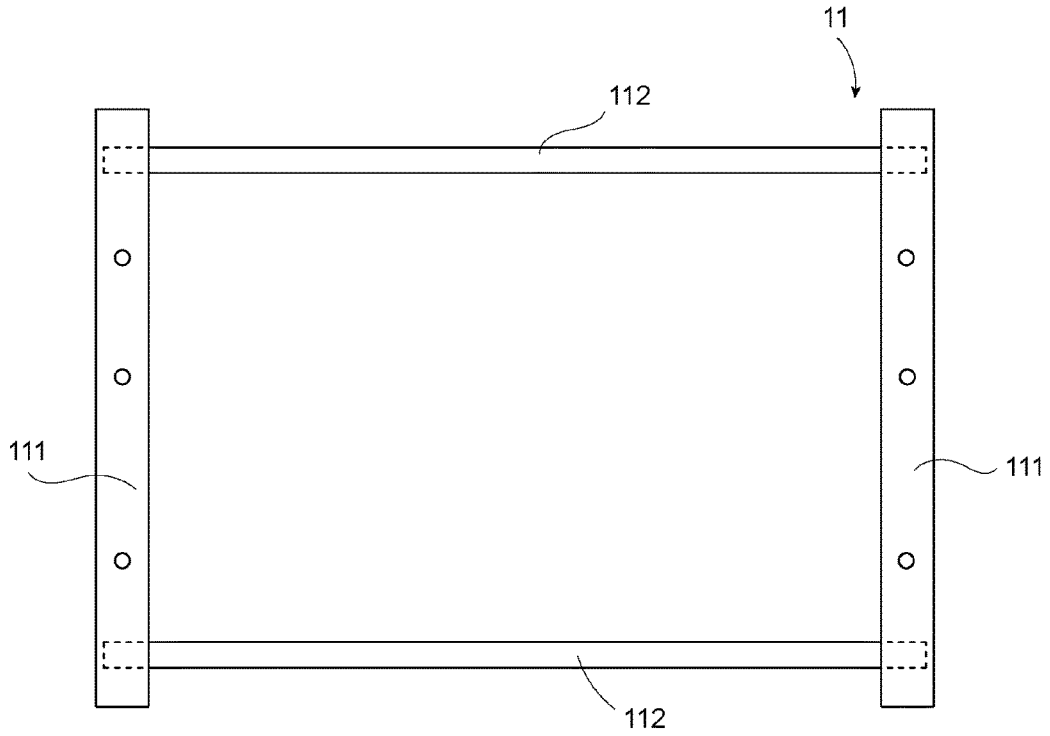
FIG. 7 is a schematic top view of the embodiment shown in FIG. 6.

As shown in FIG. 7, the way of the connection between the second opposite sides 112 of the four-sided frame and the first opposite sides 111 of the four-sided frame is as follows: both ends of each side of the second opposite sides 112 are detachably inserted respectively into blind holes at the corresponding positions of the first opposite sides 111. The broken lines in FIG. 7 indicate the inserted parts. The figured second opposite sides 112 are made of round rods. Of course, square or other section rods may also be used, as long as they could be inserted and pulled out. Wherein, the fit relationship thereof may be a clearance fit or a slight interference fit. After assembling the four-sided frame by fitting the sides together, tension-resistant thin lines 12 could be installed thereon under tension, and will tensely pull the first opposite sides 111 of the four-sided frame to keep the entire four-sided frame 11 stable and not disintegrated. (Shown in FIG. 6). When disassembling, only need to untie the tension-resistant thin lines 12, and then pull out each plug-in part of the four-sided frame. In this improved embodiment, the tension-resistant thin lines 12 play a dual role very cleverly, not only being used to support the book in use, but also being able to pull the first opposite sides 111 of the four-sided frame to prevent it from disintegrated. This improvement makes the product structure simpler and lower cost, because it does not require assembly at the factory, but allows users to assemble it by themselves, and the packaging volume greatly reduced, so the packaging and transportation costs are also greatly reduced.

As a further improvement, the supinely reading stand of the present invention may also include a line tensioner. An end of each entire tension-resistant thin line 12 can be connected to the four-sided frame via the tensioner, such that the line 12 can be tensioned more tightly, and easily adjusted to tight after the line 12 become loose by long-term use. The tighter the tension-resistant thin line 12 is, the smaller of the deformation and the more stable it is when holding the book.

Figure 8:
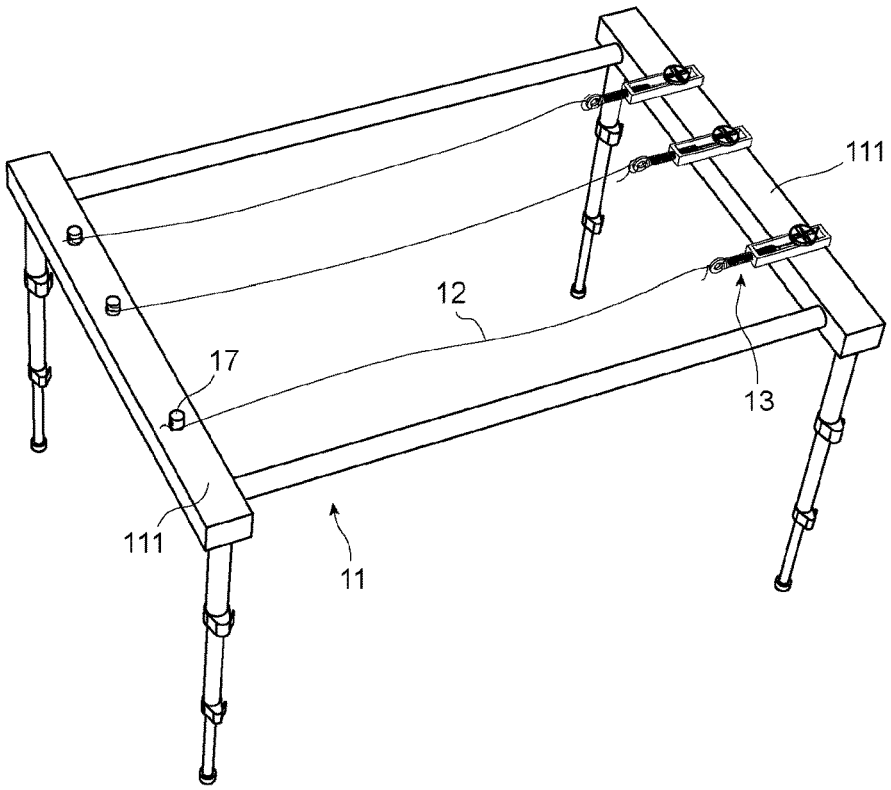
FIG. 8 is a perspective view of an embodiment of the present invention adopting a first example of the tensioner.
Figure 9:
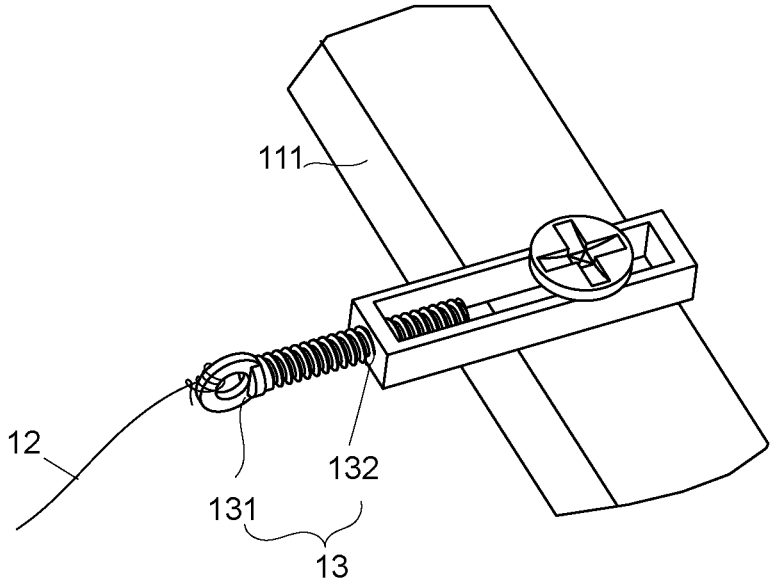
FIG. 9 is an enlarged view of the first example of the tensioner.

FIG. 8 is a perspective view of an embodiment of the present invention adopting a first example of the tensioner (Figured lines 12 are not in tension). FIG. 9 is an enlarged view of the first tensioner. According to this embodiment, the supinely reading stand includes a four-sided frame 11 and three tension-resistant thin lines 12, each of which has one end fixedly connected to the first opposite sides 111 of the four-sided frame via a terminal 17, and the other end connected to the first opposite sides 111 via a tensioner 13. The tensioner 13 includes a toward-side threaded hole 132 arranged on the first opposite sides 111 of the four-sided frame and a bolt 131 which is screw-fitted thereinto. The bolt 131 is colinear with the tension-resistant thin line 12 connected thereto, and is able to screwed in and out of the threaded hole 132 for a certain distance. Of course, both ends of the tension-resistant thin line 12 can be connected to the frame via tensioners, not only one end does as shown in FIG. 8. The threaded hole 132 shown in FIG. 9 is opened on a hollow elongated seat which is screwed onto the first opposite sides 111 of the four-sided frame. Of course, the threaded hole 132 can also be arranged directly on the first opposite sides 111 of the four-sided frame, or arranged in other ways, as long as the threaded hole 132 has a certain depth so that the bolt 131 can be screwed in and out for a certain distance to form a tensioner. When in use, tie one end of the tension-resistant thin line 12 to the terminal 17 and the other end to the bolt 131 of the tensioner 13 (FIG. 8), and screw the bolt 131 into the threaded hole 132 to make the thin line 12 tensioned. If the length of the thin line 12 is found to be inappropriate, one can unscrew the bolt 131, and then increase or reduce a few turns of the thin line wound on the terminal 17 to quickly adjust the length.

Figure 10:
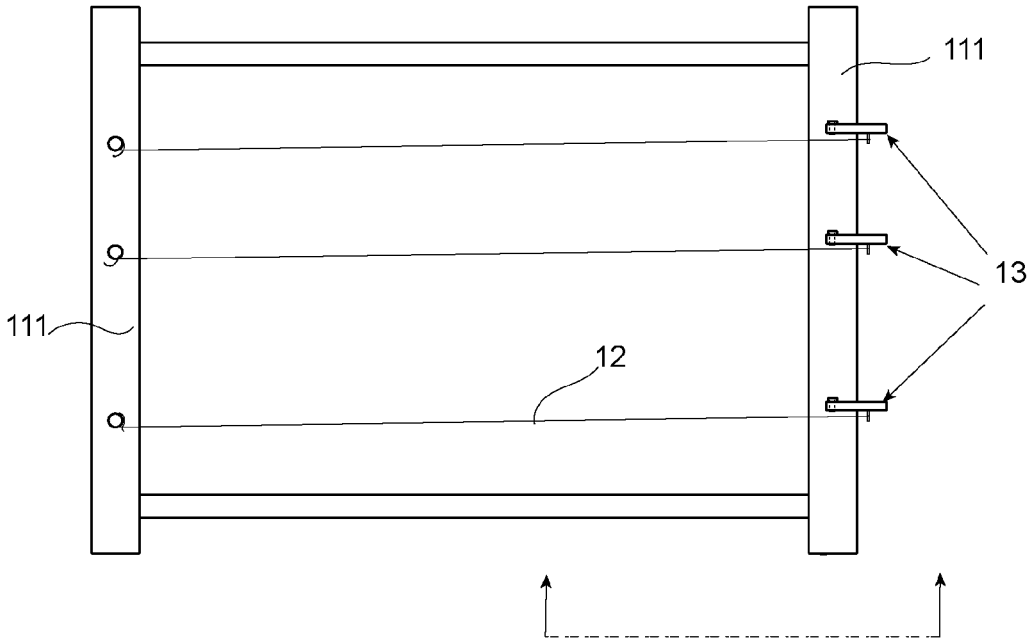
FIG. 10 is a top plan view of an embodiment of the present invention adopting a second example of the tensioner.
Figure 11:
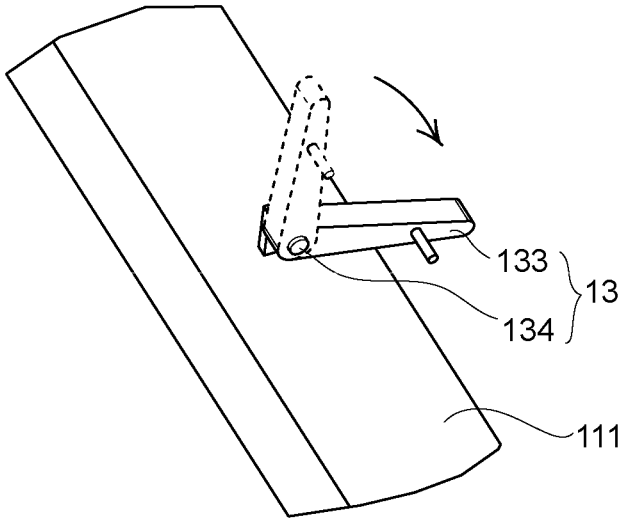
FIG. 11 is an enlarged perspective view of the second example of the tensioner.
Figure 12:
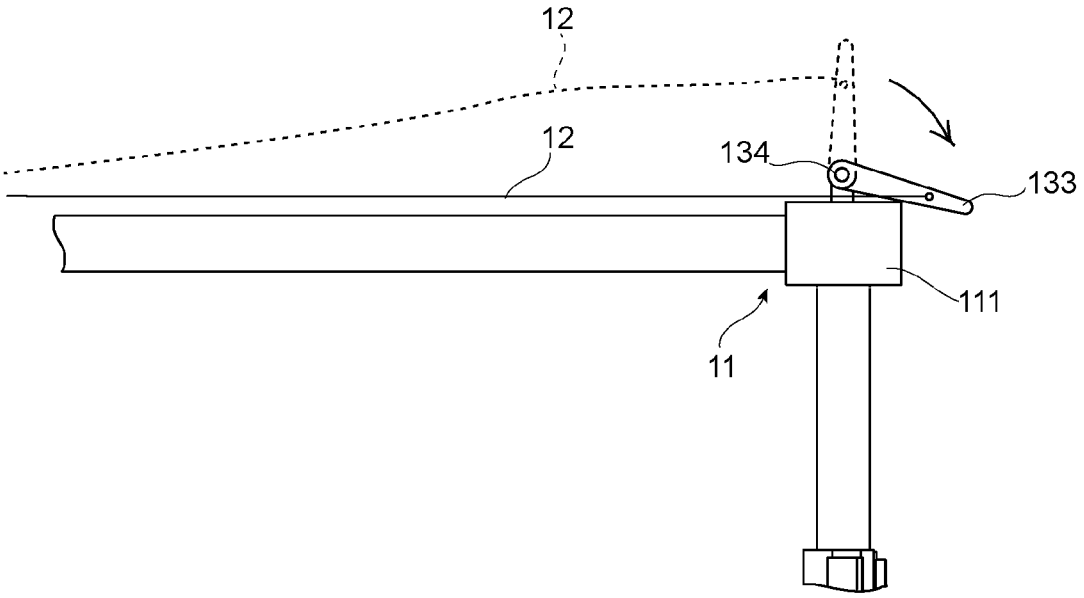
FIG. 12 is an enlarged partial front elevational view of FIG. 10 (looking from the double arrows' direction in FIG. 10)

A second example of the tensioner is shown in FIGS. 10-12. The tensioner 13 includes a spindle 134 arranged on the first opposite sides 111 of the four-sided frame and a rod 133 that can rotate therearound. One end of the tension-resistant thin line 12 is connected to the rod 133 at a certain distance away from the spindle 134. When the rod 133 is rotated from approximately the vertical position to the outside of the four-sided frame 11 (as shown by the arrow in FIG. 12), the tension-resistant thin line 12 is gradually stretched and tightened until it sweeps the spindle 134, and then the rod 133 is blocked to rotate more, and simultaneously pulled by the tension force in the thin line 12, thus snapped to the position. The benefits of this tensioner: can be locked and loosened very quickly.

Figure 13:
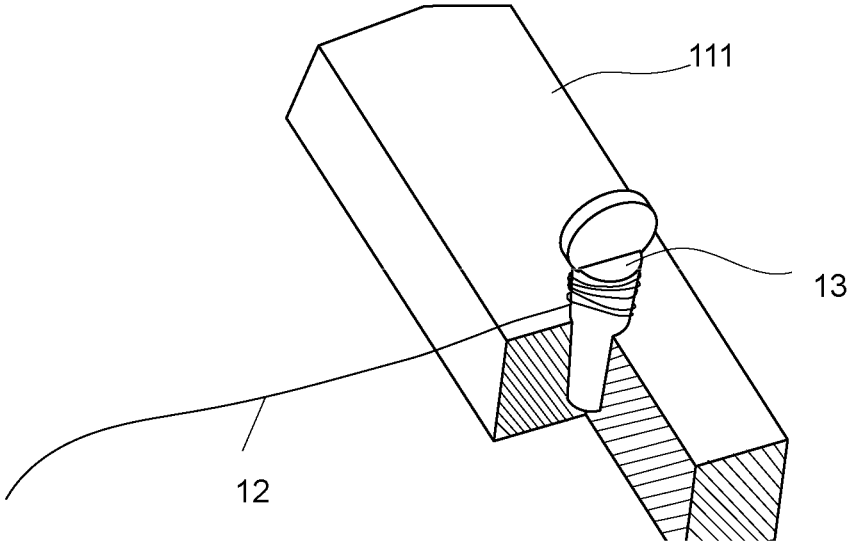
FIG. 13 is an enlarged schematic diagram of a third example of the tensioner with a partial cut-away mounting part.

As shown in FIG. 13, a third example of the tensioner 13 includes a revolving body inserted into the first opposite sides 111 of the four-sided frame. The figure shows a cone, Of course, other rotating bodies such as a cylinder or a gourd shape which are rotatable and subject to certain frictional resistance may also be used here. There can be a flat handle on the top of the revolving body, which facilitates direct twisting by hand. This kind of tensioner is simple in structure and easy to use, and is widely used on musical instruments such as erhu and violin to adjust the tension of strings.

The above-mentioned embodiment lists three different tensioners, and other various tensioners can also be used to implement the present invention, such as violin adjusters and various cable tensioners in industry. Using all these tensioners with slight modification in the present invention to achieve the tightening effect, shall fall within the protection scope of the present invention.

As another improvement, the supinely reading stand of the present invention may not adopt the above-mentioned tensioner 13, but include a spreading mechanism set on the four-sided frame 11 that can enlarge the distance between the first opposite sides 111 of the four-sided frame. By this means, the functional effect of the foregoing tensioner 13 can also be achieved, that is, the tension-resistant thin line 12 could be easily tightened, and after it becomes loose by long-term use, it could easily be tightened again. The specific embodiments can be fulfilled by improving the four-sided frame 11.

Figure 14:
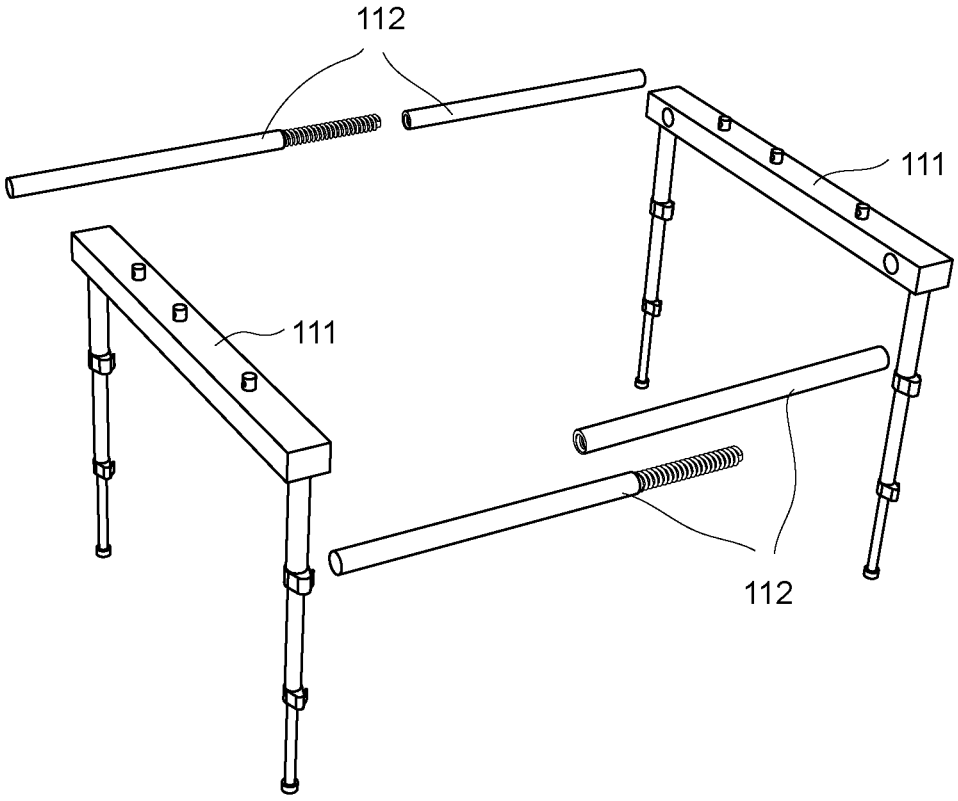
FIG. 14 is an exploded view of an embodiment of the present invention adopting a first example of the spreading mechanism.
Figure 15:
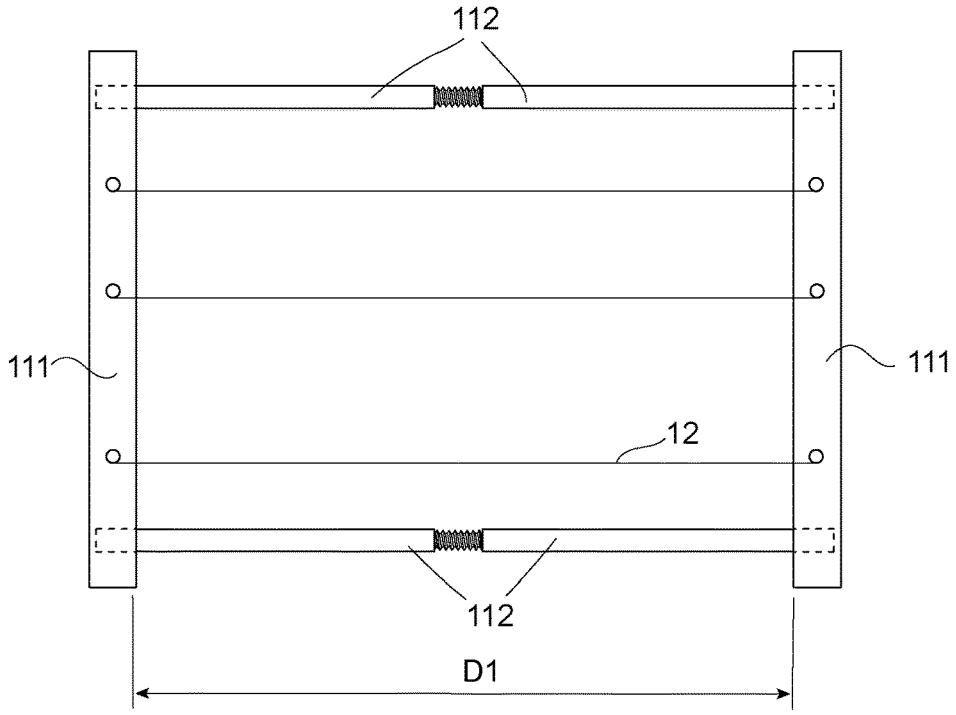
FIG. 15 is the top plan view of the embodiment of FIG. 14.

The following are embodiments of the supinely reading stand with different specific spreading mechanisms:

FIGS. 14 and 15 show an embodiment adopting a first example of the spreading mechanism. In this embodiment, the spreading mechanism in fulfilled by making the follow improvement of the four-sided frame 11:

The connection way between the second opposite sides 112 of the four-sided frame and the first opposite sides 111 is as follows: Both ends of each side of the second opposite sides 112 are inserted respectively into the blind holes at the corresponding positions of the first opposite sides 111 in a clearance fit manner. (shown by the broken line in FIG. 15); each side of the second opposite sides 112 of the four-sided frame comprises two round rods screw-fitted together with internal and external threads respectively. While the two round rods are being screwed out from one another, the overall length of them will increase, such that the distance (D1 in FIG. 15) between the first opposite sides 111 of the four-sided frame will be enlarged, so the tension-resistant thin lines 12 are further tensioned. This spreading mechanism also makes the supinely reading stand disassemblable. One only need to screw the two round rods together to shorten the total length of the two, having the tension-resistant thin lines 12 loosen, then untie and remove them, and then disassemble the four-sided frame, and finally as shown in FIG. 14. Stacking and repackaging after disassemble can greatly save packaging volume and reduce transportation costs. If a user just wanted to disassemble it temporarily for saving space in a room, he even does not need to untie or remove the thin lines, but screw the rods to shorten enough to make one end come out from the corresponding blind hole, then the other end. The thin lines may keep connected with the first opposite sides, just bent or wound there after stacking, saving time of the next-time assembly.

Figure 16:
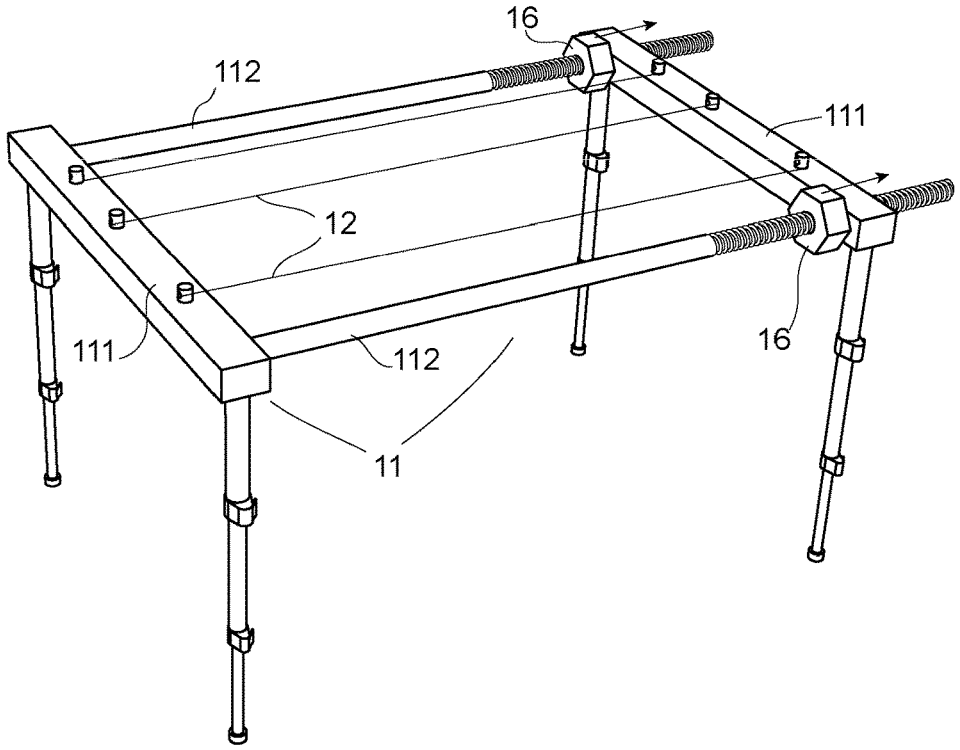
FIG. 16 is a perspective view of an embodiment of the present invention adopting a second example of the spreading mechanism.

FIG. 16 shows an embodiment adopting a second example of the spreading mechanism. According to this embodiment, Each side of the second opposite sides 112 of the four-sided frame is a round rod with an external thread at one end thereof which goes through a matching nut 16 and a corresponding through hole at the corresponding side of the first opposite sides 111 of the four-sided frame, and extends outside a certain distance; the diameter of the through hole is greater than the crest diameter of the external thread of the round rod and smaller than the outer edge of the nut 16; the nut 16 is in close contact with the inner side wall of the corresponding side of the first opposite sides 111 of the four-sided frame. While the nut 16 is rotated to move toward the outside of the four-sided frame 11 (shown by the arrow in FIG. 16), the distance between the first opposite sides 111 of the four-sided frame can be stretched longer, so the tension-resistant thin lines 12 are tensioned more. This spreading mechanism also makes the supinely reading stand disassemblable, which may reduce the volume.

Figure 17:
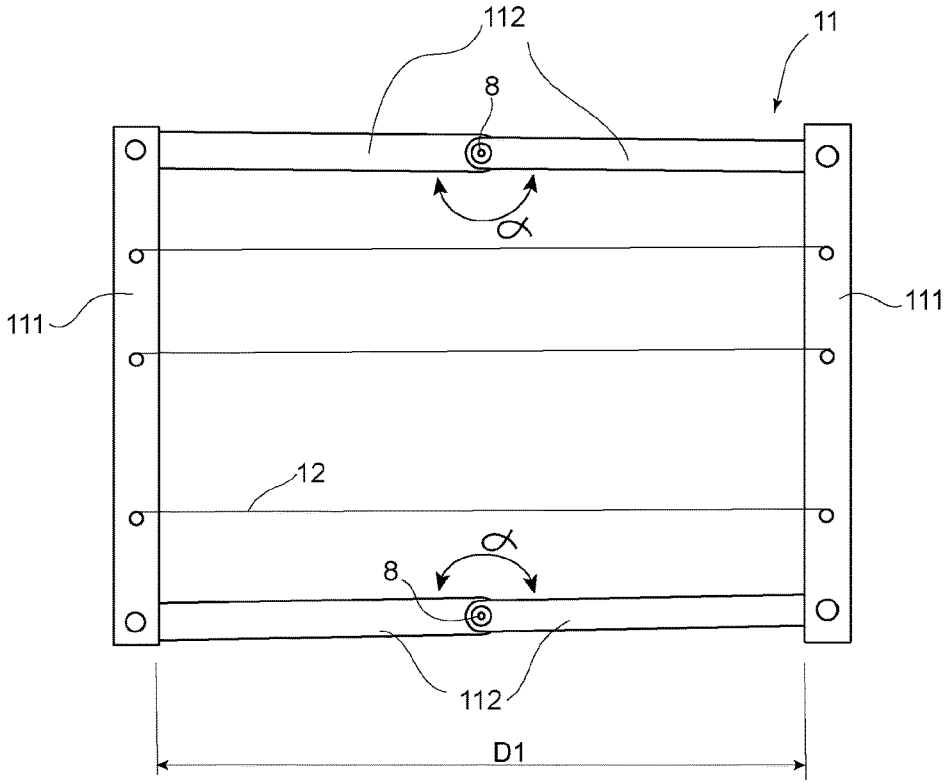
FIG. 17 is a top plan view of an embodiment of the present invention adopting a third example of the spreading mechanism.
Figure 18:
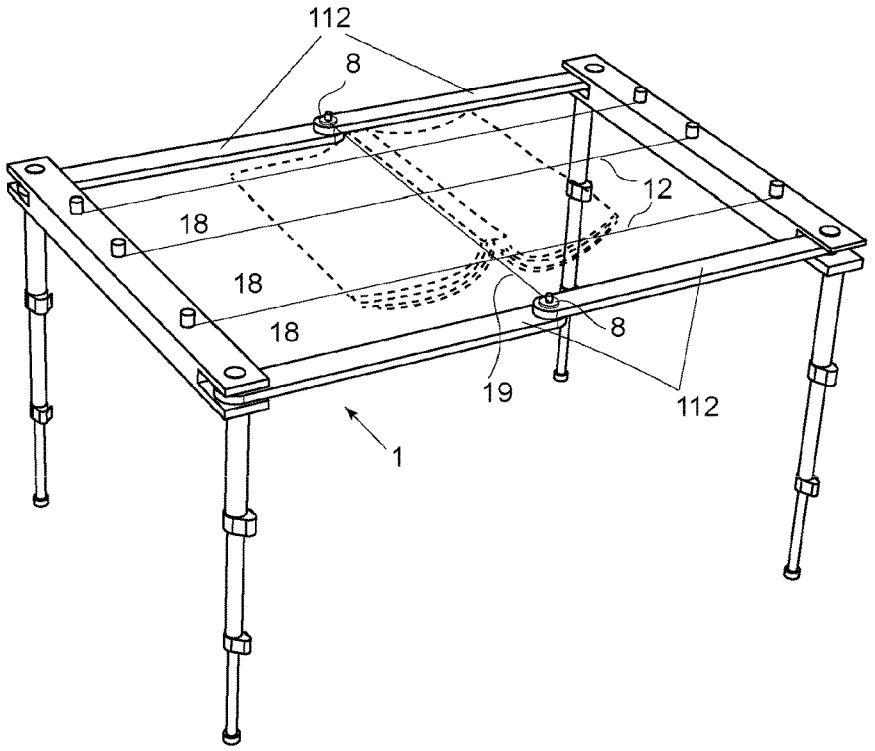
FIG. 18 is a schematic diagram illustrating the use state of the embodiment shown in FIG. 17, with a safety line.

FIGS. 17, 18 shows an embodiment adopting a third example of the spreading mechanism. According to this embodiment, the second opposite sides 112 of the four-sided frame and the first opposite sides 111 of the four-sided frame are mutually connected by hinges; each side of the second opposite sides 112 of the four-sided frame is comprised of two segmental rods with substaintially the same length connected by a hinge 8. When the angles $\alpha$ in FIG. 17 are equal to 180 degrees and the four-sided frame is generally a rectangle, the distance D1 between the first opposite sides 111 of the four-sided frame is spread to the maximum, and the tension-resistant thin lines 12 are stretched the most tightly. The angle $\alpha$ can go greater than 180 degrees, or less than 180 degrees, respectively making the four-sided frame 11 inward fold or outward fold. In this embodiment, hinges with larger rotational friction are preferred, so that when the angles $\alpha$ are adjusted to 180 degrees, the four-sided frame 11 can maintain in this shape. A screw and a nut can also be installed in the axial direction of the hinge to lock the hinge so as to make the four-sided frame 11 more stable. By adopting this spreading mechanism, not only can the tension-resistant thin line be tightened, but also the supinely reading stand can be easily and quickly folded to reduce the volume, which is "killing two birds with one stone". Additionally, it does not require untying or removing the thin lines while folding or unfolding.

It should be understood, the spreading mechanism is not limited to the above embodiments. As long as the principle of the present invention is applied, adopting any other spreading mechanism that can enlarge the distance between the first opposite sides 111 of the four-sided frame will also fall within the protection scope of the present invention. The spreading mechanism and the line tensioner in the foregoing embodiments can also be used at one together, which does not conflict.

The foregoing embodiments of the present disclosure still have one problem: When in use, the book may possibly slip through one gap (FIG. 2, (18)) between the tension-resistant thin lines 12 and hit the user's face. An embodiment shown in FIG. 18 is provided to further solve this problem. In this embodiment, the book-supporting structure 1 of the supinely reading stand further includes a safety line 19 preventing the book from falling off. The safety line 19 is a stretched-to-straight thin line whose ends are attached respectively to the substantially middle positions of each of the second opposite sides 112 of the four-sided frame. This thin line 19 can be an ordinary thin line, which does not need to bear long-term tension, but only need to be stretched to basically straight. The dashed part in FIG. 18 indicates the book placed on the support structure 1, and the crack of two adjacent pages of the book is basically aligned with the safety line 19 after the book is opened. When the book accidentally slips from tension-resistant thin lines 12 entering the gap 18, the safety line 19 can just catch the crack of the book and prevent the book from falling. This embodiment (FIG. 18) also adopts the aforementioned third example of spreading mechanism, and the two ends of the safety line 19 are respectively tied to the hinges' 8 spindles. Of course, for all other embodiments of the present invention, the safety line 19 can be preferably included, and the connection way of the safety line 19 can be tied directly to the middle positions of each of the second opposite sides 112 of the four-sided frame, or alternatively tied via terminals set at the corresponding positions thereof.

Figure 19:
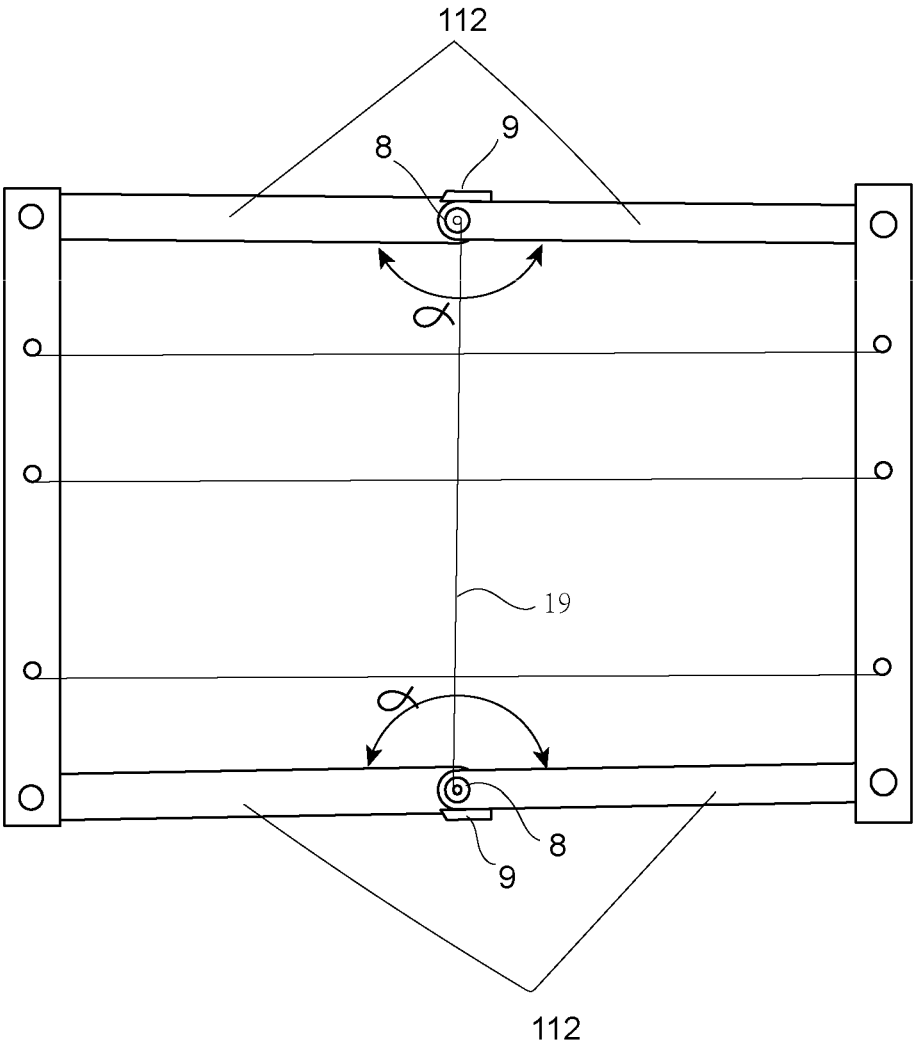
FIG. 19 is a top view of an embodiment including an improved third example of the spreading mechanism and the safety line.
Figure 20:
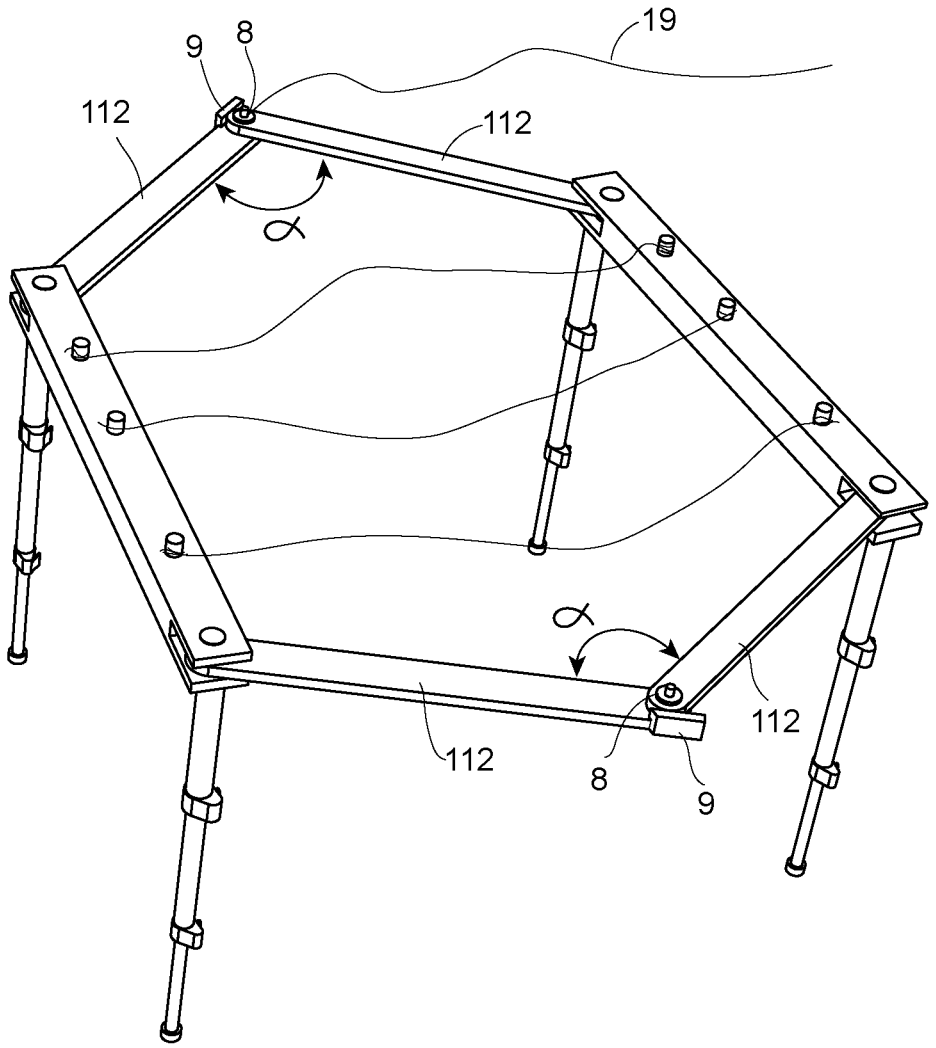
FIG. 20 is a schematic diagram of the folding process of the embodiment in FIG. 19.

The aforementioned third example of spreading mechanism could be further optimized, as shown in the embodiment of FIGS. 19 and 20. FIG. 19 is a top view of an embodiment including an improved third example of the spreading mechanism and the safety line 19, and FIG. 20 is a schematic diagram of the folding process of the embodiment in FIG. 19. Based on the foregoing third example of the spreading mechanism, this embodiment further includes a stopper 9 and a safety line 19. The stopper 9 is arranged on the edge of one rotatable segmental rod outside of the hinge 8, making the angle $\alpha$ can only reach 180 degrees at most. When the angle $\alpha$ is increased to 180 degrees, the stopper 9 will block the hinge from further rotating. Then, install the safety line 19 to finally form the state shown in FIG. 19, wherein the safety line 19 pulls the two hinges 8 so that the a angle cannot be reduced, so the a angle is stably maintained at 180 degrees. The advantage of this embodiment is that even if the hinges 8 are without great rotational friction resistance and without a hinge-locking device, the entire four-sided frame can be still maintained in a stable state.

The supinely reading stand of the present invention, in addition to the book-supporting structure 1, also includes a positioning structure 2 (FIG. 1). In the basic embodiment shown in FIG. 1, the positioning structure 2 includes four telescopic legs (poles) connected to the book-support structure 1, forming a table shape as a whole. There are a large number of solutions for telescopic poles in the prior art. For example, telescopic poles of the common microphone brackets or camera stands could be used in the present invention. The embodiment in FIG. 1 uses a telescopic pole commonly used in camera tripods which is composed of multiple hollow-tube segments with decreasing diameters one by one. Each segment is controlled by a rotatable plastic bar (known as "articulating snap"). Wrenching the rotatable plastic bar outward or pressing it backward will make the telescopic pole telescopically adjustable or locked respectively. With this kind of telescopic pole, it is easy to adjust the height of reading stand quickly, thereby easy to adjust the distance between the book and one's eyes.

Figure 22:
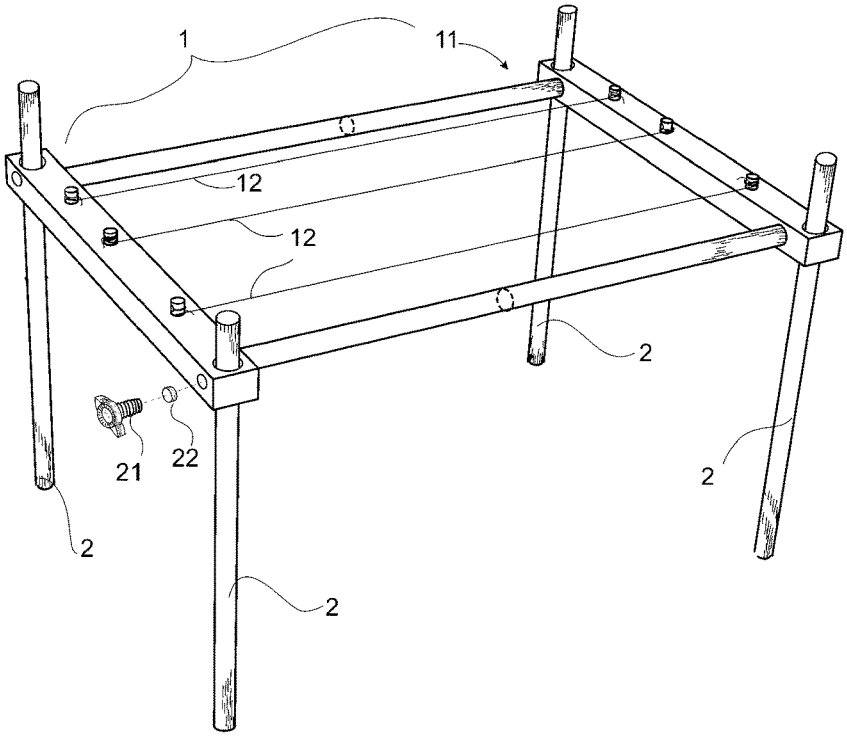
FIG. 22 is a schematic diagram of an embodiment of the present invention comprising an improved positioning structure

As shown in FIG. 22, an embodiment of the present invention comprises another improved positioning structure 2 which includes four straight rods adjustably and detachably connected to the four-sided frame 11 at the four corners thereof respectively. Each of the straight rods can penetrate through a through hole provided at the corresponding corner of the four-sided frame 11, and be locked in a certain place by a pressing screw 21, enabling the height of the four-sided frame 11 adjustable. The pressing screws 21 are preferably thumb screws. Further, an elastic cushion 22 is provided between each pressing screw 21 and the corresponding straight rod, in a corresponding screw hole, contributing to provide more even friction resistance to lock the straight rod better and protect its surface appearance. Base on that foregoing proposal in FIG. 7, this improved embodiment (FIG. 22) can make the supinely reading stand totally disassemblable, more precisely, disassembled to eight rod-shaped members (four legs and four that form the frame). These eight rod-shaped members can be repacked to a bunch, which saves space significantly. The advantages also contain: simpler in the structure of the product; more stable and firmer; more suitable for mass production; convenient for a user to replace the broken rod-shaped member while self-repairing; lower cost, etc.

The positioning structure (2) can also be in various other ways, and there were a large number of solutions in the prior art. For example, there were also: the solution of using two inverted—"T"-shaped legs to place on the bed, the solution of fixing to a ceiling or a side wall by a cantilever rod, the floor-standing and cantilevered type, and the solution of multiple rods clamped on the headboard, etc. In short, as long as a structure is connected to the book-supporting structure (1) and able to keep the book-supporting structure (1) in a certain position relative to the bed, floor, wall, headboard, etc., it belongs to the positioning structure (2).

Figure 21:
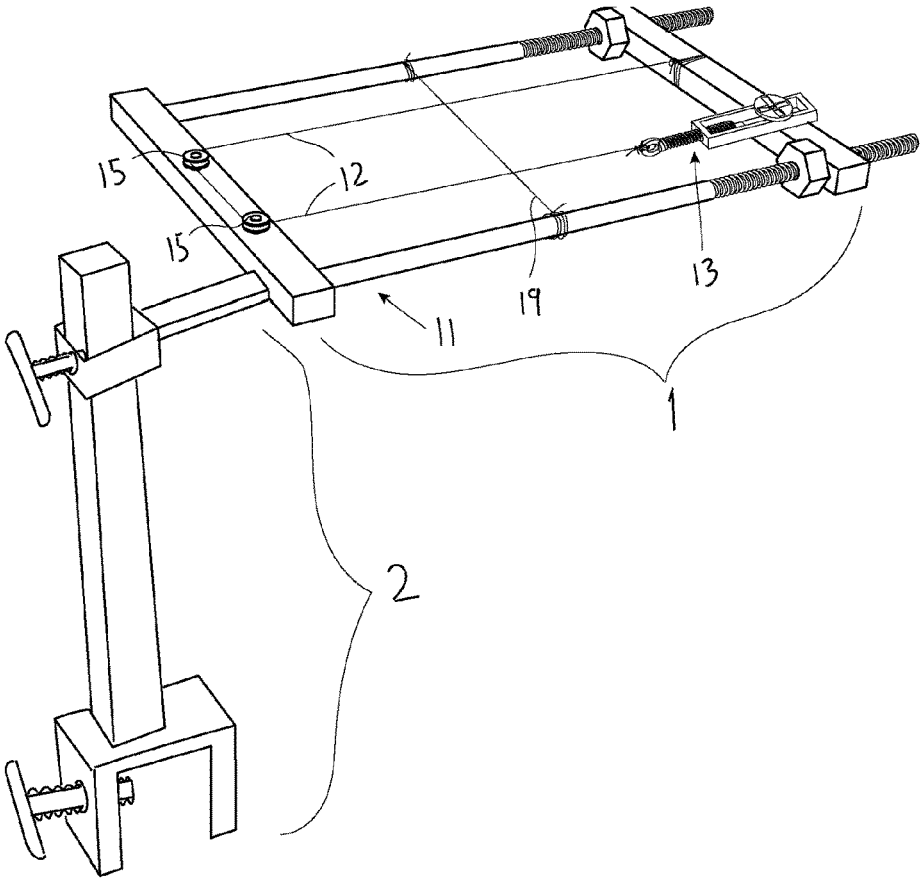
FIG. 21 is a variety embodiment under the principle of the present invention.

What should be emphasized are: All the above-mentioned embodiments should not be construed as limitations on the specific implementation structure of the present invention. There are many improved techniques disclosed in the above-mentioned preferred embodiments that are for solving different problems. Those skilled in the art can understand, these techniques can be utilized independently or in permutation combination, for reaching many other different embodiments under the spirit of the present invention, all of which belong to the protection scope of the present invention. In order to better illustrate this point, for instance, here another embodiment is provided in FIG. 21, which is a variety derived from the foregoing different embodiments and utilizes simultaneously novel techniques of them under the principle of the present invention. The supinely reading stand in this embodiment includes a book-supporting structure 1 and a positioning structure 2. The book-supporting structure 1 includes a four-sided frame 11 and two tension-resistant thin lines 12 distributed in the inner area thereof, also includes a safety line 19. The two tension-resistant thin lines 12 are actually formed by one entire tension-resistant thin line bypassing around two pulleys 15, and one end of the entire line is connected to the four-sided frame 11 via a tensioner 13. The four-sided frame 11 is also provided with a spreading mechanism. The positioning structure 2 is a common structure in the prior art composed of rods and clamps, which can clamp the headboard to fix the entire supinely reading stand and adjust the height of the book-supporting structure 1.

The invention is to be limited only by the spirit and scope of the appended claims.

What is claimed is:

1. A supinely reading stand comprising:

a book-supporting structure comprising a four-sided frame and at least one tension-resistant thin line distributed in an inner area of the four-sided frame, wherein the four-sided frame includes first opposite sides and second opposite sides, wherein the at least one tension-resistant thin line is tensely stretched and connected to the first opposite sides of the four-sided frame, wherein at least one end of each entire tension-resistant thin line is connected to the four-sided frame via a tensioner, wherein a way of the connection between the second opposite sides of the four-sided frame and the first opposite sides of the four-sided frame is as follows: both ends of each side of the second opposite sides are detachably inserted respectively into blind holes at corresponding positions of the first opposite sides; and a positioning structure connected to the book-supporting structure.

2. The supinely reading stand of claim 1, wherein the tensioner includes a toward-side threaded hole arranged on the first opposite sides of the four-sided frame and a bolt which is screw-fitted thereinto, wherein the bolt is colinear with the tension-resistant thin line connected thereto, and is able to screwed in and out of the threaded hole for a certain distance.

* * * * *